US007371092B2

(12) United States Patent
Okumura et al.

(10) Patent No.: US 7,371,092 B2
(45) Date of Patent: May 13, 2008

(54) WATERPROOF CONNECTOR WITH A FILTER IMPERMEABLE TO LIQUID BUT PERMEABLE TO AIR AND A SEAL MEMBER IMPERMEABLE TO BOTH LIQUID AND AIR

(75) Inventors: Tatsuya Okumura, Gifu (JP); Tomohiro Nakamura, Aichi (JP); Tomohiko Funahashi, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 11/775,468

(22) Filed: Jul. 10, 2007

(65) Prior Publication Data

US 2008/0014793 A1 Jan. 17, 2008

(30) Foreign Application Priority Data

Jul. 11, 2006 (JP) ..... 2006-190923

(51) Int. Cl.
*H01R 4/60* (2006.01)

(52) U.S. Cl. ..... 439/205

(58) Field of Classification Search ..... 439/205, 439/206, 198, 199, 274, 275, 278, 283
See application file for complete search history.

(56) References Cited

U.S. PATENT DOCUMENTS

| | | | | |
|---|---|---|---|---|
| 6,071,147 | A * | 6/2000 | Tsukamoto | 439/587 |
| 6,210,191 | B1 * | 4/2001 | Sai | 439/274 |
| 6,371,796 | B2 * | 4/2002 | Fukuda | 439/489 |
| 6,655,978 | B2 * | 12/2003 | Lutsch et al. | 439/352 |
| 6,783,381 | B2 * | 8/2004 | Fukuda | 439/271 |
| 6,827,232 | B1 * | 12/2004 | Hara et al. | 220/371 |
| 2005/0046081 | A1 * | 3/2005 | Hara et al. | 264/275 |

* cited by examiner

*Primary Examiner*—Chandrika Prasad
(74) *Attorney, Agent, or Firm*—Sughrue Mion, PLLC

(57) ABSTRACT

In a waterproof connector (1), a filter (151), which is impermeable to liquid and permeable to air, is arranged between an outer circumferential surface of an insulating coating layer (13) of a first electric wire (11) and a wall surface of the first hole (33). On the other hand, a seal member (51), which is impermeable to liquid and air, is arranged between an outer circumferential surface of an insulating coating layer (313) of a second electric wire (311) and a wall surface of the second hole (313).

9 Claims, 6 Drawing Sheets

WATERPROOF CONNECTOR WITH A FILTER IMPERMEABLE TO LIQUID BUT PERMEABLE TO AIR AND A SEAL MEMBER IMPERMEABLE TO BOTH LIQUID AND AIR

BACKGROUND OF THE INVENTION

1. Field of the Invention

The present invention relates to a waterproof connector.

2. Description of the Related Art

A gas sensor (hereinafter, also referred to as a sensor) for detecting a specific component of exhaust gas usually employs a waterproof structure for isolating an interior space (hereinafter, also referred to as an internal space) of the gas sensor casing from the exterior thereof to prevent foreign matter, such as water, from entering into the casing. When an engine having such a sensor attached to an exhaust pipe of the engine is running, a front end of the sensor is exposed to high-temperature exhaust gas. Thus, due to thermal conduction, the internal space of the sensor assumes a high temperature. When the engine is shut off, the internal space is cooled. In order to prevent expansion and contraction (variation in pressure) of air contained in the internal space (hereinafter, also referred to as internal air) caused by such thermal variation, the sensor, for example, may allow for exchange of internal air through its rear end portion. Specifically, the sensor may employ a filter which is permeable to air, but is impermeable to liquid.

On the other hand, in order to meet a demand for reduction in size and enhancement of waterproofness, a certain sensor (hereinafter, also referred to as a completely waterproof sensor) has a closed internal space without employing a filter for exchange of internal air. In sensors including such a completely waterproof sensor, a waterproof connector is usually attached to end portions (terminals) of electric wires extending outwardly therefrom. The waterproof connector is fitted, for connection, to a counterpart waterproof connector attached to external terminals of electric wires extending outwardly from an engine control unit (ECU).

In the case where electric wires of the completely waterproof sensor are connected to corresponding electric wires by use of waterproof connectors, the presence of an opening (defect) in an insulating coating layer of an electric wire connected to a counterpart waterproof connector, through which opening an internal core wire(s) is exposed to outside air, causes the following phenomenon in association with variation in air pressure of the internal space of the sensor during use. When the air pressure of the internal space becomes high as a result of exposure to heat, air contained in the internal space flows through an electric wire (i.e., through small clearances between a large number of the core wires constituting the electric wire) covered with the insulating coating layer, and flows out of the electric wire from the opening. In contrast, when the internal space assumes a negative pressure (vacuum) as a result of cooling, the outside air is drawn in from the opening. Accordingly, when water is splashed over the opening or when the opening is immersed in water, water is drawn in from the opening and flows through the electric wire toward the internal space of the sensor. As a result, when the completely waterproof sensor is repeatedly used, metal terminals or the like contained in the waterproof connectors (hereinafter, also referred to as connectors) and the sensor may corrode.

Measures to solve the above problem include use of a waterproof connector having a filter which is impermeable to liquid, but is permeable to air for allowing air flow between the interior and the exterior of the connector (as disclosed, for example, in Patent Documents 1 and 2). In the waterproof connector disclosed in Patent Document 1, a sealing rubber plug for preventing entry of foreign matter such as water is fitted into an idle cavity (hole) of a housing into which a metal terminal is not inserted; a through-hole extending between the interior and the exterior of the hole is formed in the rubber plug; and a filter which is permeable to air, but is impermeable to liquid, is provided in the through-hole.

In the connector disclosed in Patent Document 2, a sleeve-type filter (seal member) which can restrict passage of liquid and is permeable to air is arranged between an electric wire (lead wire) and a wall of an electric-wire insertion hole of a casing (hereinafter, referred to as housing) through which the electric wire is inserted, such that the outer circumferential surface of the filter is in close contact with the wall of the hole.

In the case where electric wires of the above-mentioned completely waterproof sensor are connected to corresponding electric wires by use of the waterproof connector disclosed in Patent Documents 1 or 2, provision of the air-permeable filter (or seal member) in the connector solves the above-noted problem due to variation in pressure within the sensor in a cooling-heating cycle, thereby preventing entry of foreign matter such as water into the connector or the sensor through the electric wire. That is, even when an opening (defect) is present in an electric wire connected to a counterpart waterproof connector, and the opening is immersed in water, water is not drawn in toward the sensor.

[Patent Document 1] Japanese Patent Application Laid-Open (kokai) No. 2003-331979

[Patent Document 2] Japanese Patent Application Laid-Open (kokai) No. 4-249079

3. Problems to be Solved by the Invention:

However, in the waterproof connector disclosed in Patent Document 1, the filter is provided in the sealing rubber plug which is inserted into the idle cavity (unused hole) into which no metal terminal is inserted. Accordingly, the waterproof connector employs a number of holes greater than the number of electric wires to be inserted into the holes. That is, in the waterproof connector of Patent Document 1, since the sealing rubber plug is inserted into a hole into which no metal terminal is inserted, an idle hole must also be provided. In other words, a connector of greater size must be used which is disadvantageous.

In the connector disclosed in Patent Document 2, even when a plurality of electric wires are inserted into a respective plurality of holes, the filters must be inserted between the wall surface of each hole and the outer circumferential surface of each electric wire. Thus, the filter attachment structure employed by the waterproof connector of Patent Document 2 suffers from poor waterproof reliability and high cost.

SUMMARY OF THE INVENTION

The present invention has been accomplished in view of the above-noted problems associated with conventional waterproof connectors, and an object thereof is to provide a highly reliable waterproof connector which dispenses with the need for an idle hole and in which a filter permeable to air and capable of preventing passage of liquid is stably held in a hole, as well as a sensor using the waterproof connector.

In a first aspect (1), the above object of the present invention has been achieved by providing a waterproof connector including:

a housing having first and second holes;

a first electric wire inserted into the first hole, the first electric wire including a core wire and a insulating coating layer covering the core wire;

a first metal terminal connected to the core wire of the first electric wire in the first hole;

a filter impermeable to liquid and permeable to air arranged between an outer circumferential surface of the insulating coating layer of the first electric wire and a wall surface of the first hole;

a second electric wire inserted into the second hole, the second electric wire including a core wire and an insulating coating layer covering the core wire;

a second metal terminal connected to the core wire of the second electric wire in the second hole, and a seal member impermeable to liquid and air arranged between an outer circumferential surface of the insulating coating layer of the second electric wire and a wall surface of the second hole.

According to the waterproof connector (1) of the present invention, a filter which is impermeable to liquid but permeable to air is arranged between an outer circumferential surface of the insulating coating layer of the first electric wire and a wall surface of the first hole, while a seal member which is impermeable to both liquid and air is arranged between an outer circumferential surface of the insulating coating layer of the second electric wire and a wall surface of the second hole. Since a vacant hole is not needed in accordance with the structure (1) above, the size of the connector can be kept compact. Furthermore, since there is no need to provide each hole with a filter, waterproofing reliability of the connector can be enhanced without incurring cost problems.

In a preferred embodiment (2) of the waterproof connector according to (1) above, the first metal terminal comprises:

a first core wire crimp portion crimping the core wire of the first electric wire, and a filter crimp portion crimping the filter.

According to the waterproof connector (2) of the present invention, the filter is crimped by the filter crimp portion so as to be securely held within the first hole.

In a preferred embodiment (3) of the waterproof connector according to (2) above, the filter comprises a large-diameter portion, and a small-diameter portion having an outer diameter smaller than that of the large-diameter portion, the small-diameter portion being crimped by the filter crimp portion of the first metal terminal.

According to the waterproof connector (3) of the present invention, the small-diameter portion of filter is crimped by the filter crimp portion of the first electric wire. Thus, even if air permeability of the small diameter portion deteriorates due to crimping, air permeability through a step portion provided between the larger-diameter portion and the small-diameter portion is secured.

In a preferred embodiment (4), the waterproof connector according to claim 1 further comprises a ring packing arranged between an outer circumferential surface of the filter and the wall surface of the first hole.

According to the waterproof connector (4) of the present invention, the ring packing keeps the region between the between an outer circumferential surface of the filter and the wall surface of the first hole waterproof, even if the filter lacks elasticity.

In a preferred embodiment (5) of the waterproof connector according to (1) above, an outer circumferential surface of the filter is pressed directly against the wall surface of the hole.

According to the waterproof connector (5) of the present invention, water impermeability between the outer circumferential surface of the filter and the wall surface of the hole can be secured in the absence of a ring packing.

In a preferred embodiment (6) of the waterproof connector according (1) above, the second metal terminal comprises:

a second core wire crimp portion crimping the core wire of the second electric wire, and a seal member crimp portion crimping the seal member.

According to the waterproof connector (6) of the present invention, the seal member is crimped by the seal member crimp portion so that the seal member is securely held within the second hole.

In a preferred embodiment (7) of the waterproof connector according to (6) above, the seal member comprises a large-diameter portion, and a small-diameter portion having an outer diameter smaller than that of the large-diameter portion, the small-diameter portion being crimped by the seal member crimp portion of the second metal terminal.

According to the waterproof connector (7) of the present invention, the seal member crimp portion crimps the small-diameter portion of the seal member. Thus, the seal member crimp portion can be made compact.

In a preferred embodiment (8) of the waterproof connector according to (1) above, an outer circumferential surface of the seal member is pressed directly against the wall surface of the second hole.

According to the waterproof connector (8) of the present invention, an outer circumferential surface of the seal member is pressed directly against the wall surface of the second hole so that water impermeability is secured between the outer circumferential surface of the seal member and the wall surface of the second hole.

In a preferred embodiment (9), the waterproof connector according to (1) above comprises said second hole in greater number than said first hole.

According to the waterproof connector (9) of the present invention, due to a larger number of seal members, water proof reliability can be enhanced. Preferably, no more than one first hole is present to enhance water proof reliability to the extent possible.

DESCRIPTION OF REFERENCE NUMERALS

Figure 1:
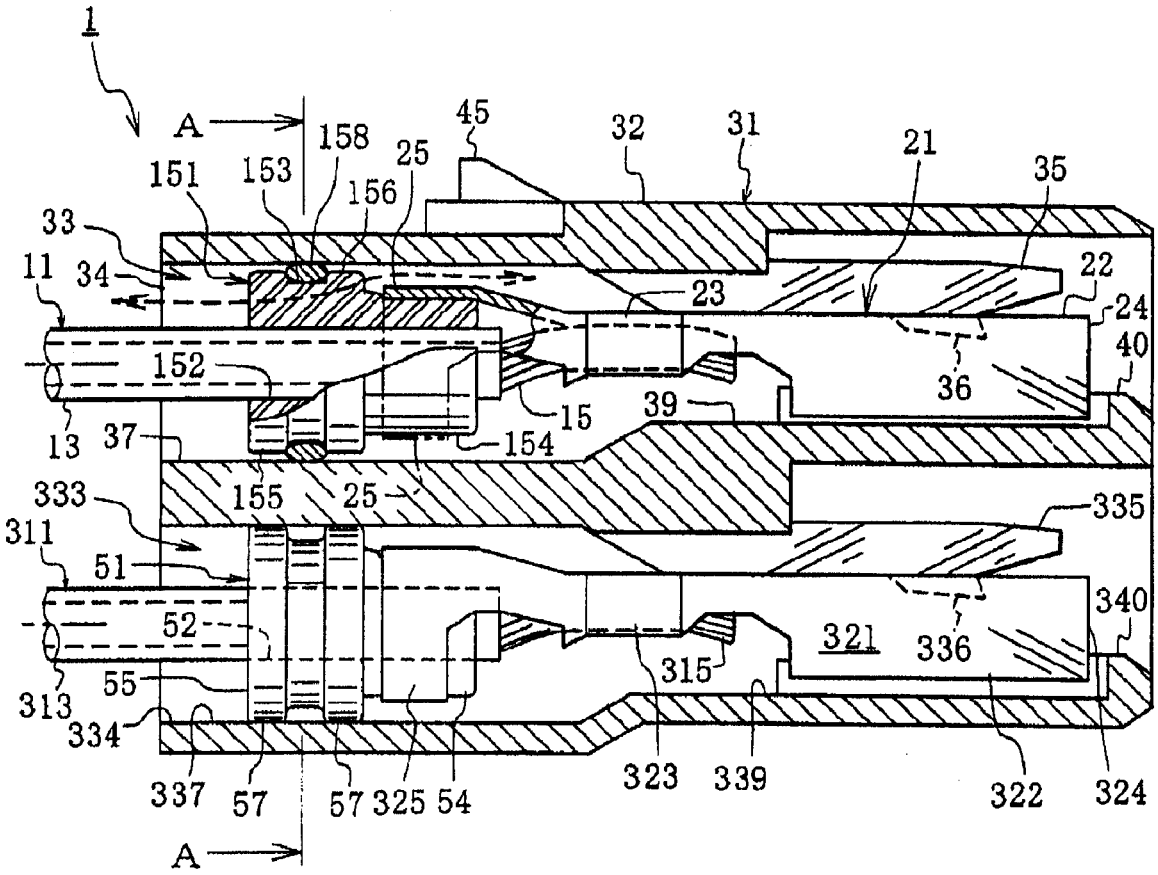
FIG. 1 is a sectional view showing an embodiment of a waterproof connector of the present invention.
Figure 2:
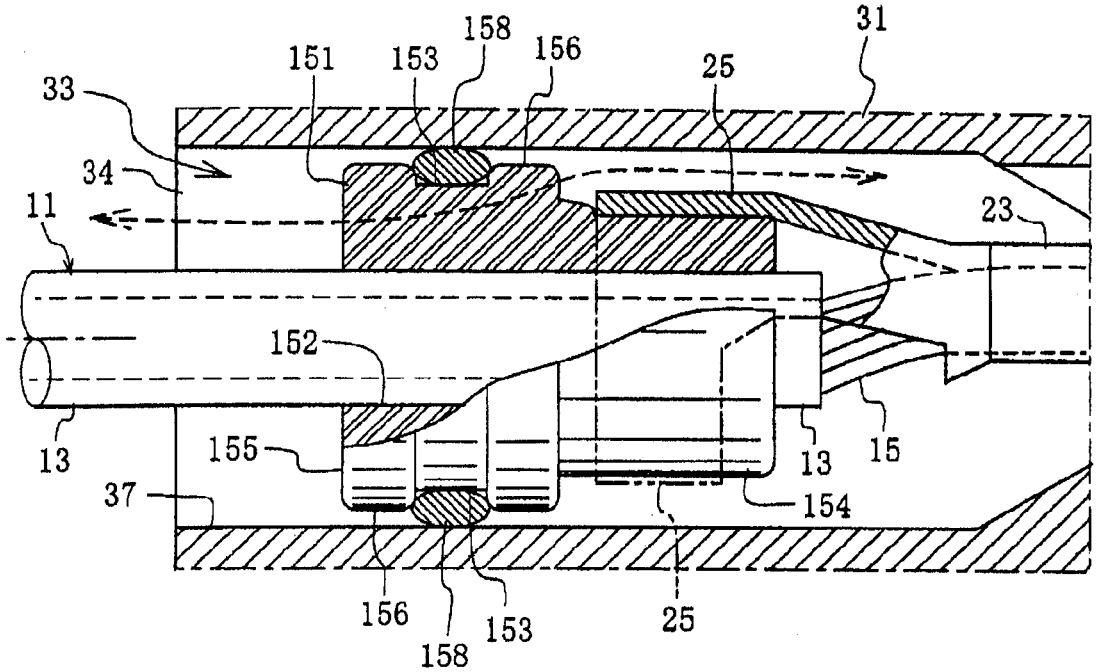
FIG. 2 is an enlarged view of certain portions of FIG. 1.

Reference numerals used to identify various structural features in the drawings include the following.

1, 2, 3: waterproof connector
11: first electric wire
13: insulating coating layer of first electric wire
15: core wire of the first electric wire
21: first metal terminal
23: first core wire crimp portion
25: seal-member crimp portion of first metal terminal
31: housing
33: first hole
51: seal member
54: small-diameter portion of seal member
55: large-diameter portion of seal member
58: ring packing having rubberlike elasticity
100: gas sensor
151, 151*b*, 151*c*: filter
154: small-diameter portion of filter
155: large-diameter portion of filter
158: ring packing
153: groove on outer circumferential surface of large-diameter portion of filter
311: second electric wire
313: insulating coating layer of second electric wire
315: core wire of the second electric wire
321: second metal terminal
323: second core wire crimp portion
325: filter crimp portion
333: second hole

DETAILED DESCRIPTION OF THE PREFERRED EMBODIMENTS

The present invention will next be described in greater detail with reference to FIGS. 1 to 4. However, the present invention should not be construed as being limited thereto.

Figure 4:
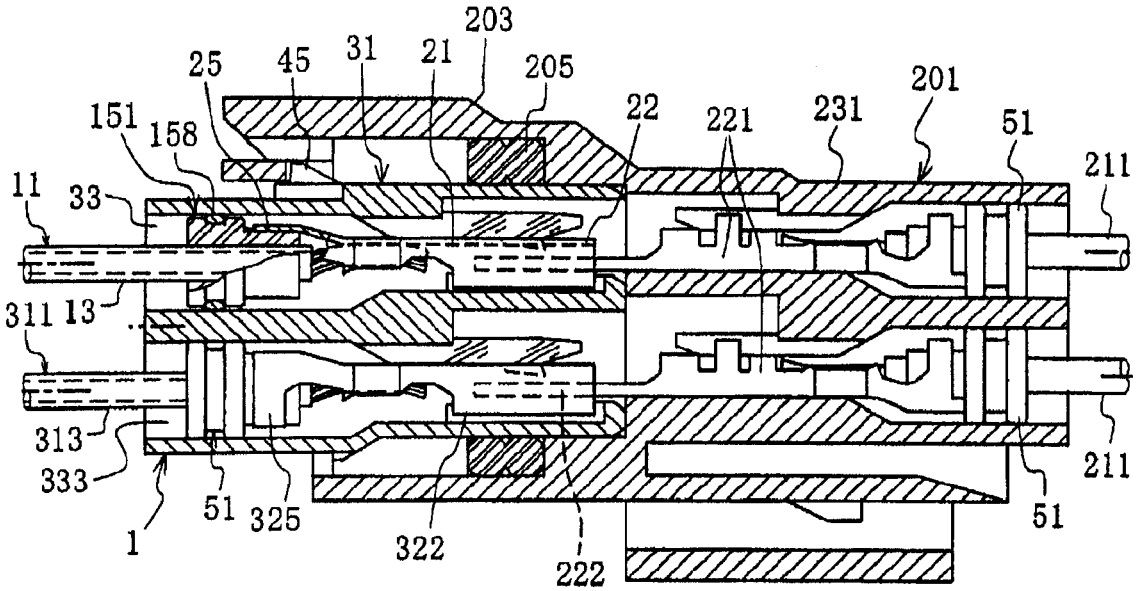
FIG. 4 is a view showing the mating of the waterproof connector of FIG. 1 and a counterpart waterproof connector.

FIG. 1 shows a waterproof connector according to the present invention. The present mode embodies a waterproof connector in which female first and second metal terminals 21, 321 are fixedly attached to respective end portions (right end portions in FIG. 1) of first and second electric wires 11, 311. As shown in FIG. 4, a counterpart waterproof connector 201 is externally fitted to a housing 31 of a waterproof connector 1, whereby the terminals are mutually connected. The waterproof connector (hereinafter, also referred to as a connector) 1 of the present mode includes a housing 31 having a first hole 33 and a second hole 333; a first electric wire 11 inserted into the first hole 33; a first metal terminal 21 connected with a core wire 15 of the first electric wire 11 in the first hole 33; a filter 151 provided between an insulating coating layer 13 of the first electric wire 11 and the first hole 33; a second electric wire 311 inserted into the second hole 333; a second metal terminal 321 connected with a core wire 315 of the second electric wire 311 in the second hole 333, and a seal member 51 provided between an insulating coating layer 313 of the second electric wire 311 and the second hole 333.

The first metal terminal 21 includes: a first core wire crimp portion 23 crimping the core wire 15 of the first electric wire 11, and a filter crimp portion 25 crimping a small diameter portion 154 of the filter 151. On the other hand, the second metal terminal 321 includes: a second core wire crimp portion 323 crimping the core wire 315 of the second electric wire 311, and a seal member crimp portion 325 crimping a small diameter portion 54 of the seal member 51.

The filter 151 is impermeable to water and permeable to air as represented by the broken line in FIG. 1 (air can pass through the filter 151). The filter 151 has fine, continuous pores so as to provide air permeability. The filter 151 is formed from PTFE (polytetrafluoroethylene). The filter 151 is formed by charging a PTFE powder into a mold; compressing the PTFE powder with a compressive force to such an extent that clearances are formed between particles of the PTFE powder; and heating the PTFE powder at a temperature lower than the melting point of PTFE so as to fuse particles together. In microscopic view, the filter 151 has a continuously porous structure such that fine pores are continuously formed in three dimensions.

The filter 151 comprises a large-diameter portion 155, and a small-diameter portion 154 having an outer diameter smaller than that of the large-diameter portion 155. The filter 151 further includes an electric-wire insertion hole 152 in which the first electric wire 11 is inserted. The outer circumferential surface of the small-diameter portion 154 is crimped by the filter crimp portion 25 so that liquid-tightness between the outer circumferential surface of the insulating coating layer 13 of the first electric wire 11 is secured. Although air permeability of the small-diameter portion 154 is deteriorated due to the crimp, air permeability of the filter 151 can be secured at the shoulder portion between the small-diameter portion 154 and the large-diameter portion 155. A ring packing (O-ring) 158 having rubberlike elasticity is fitted into the groove 153, thereby establishing liquid-tightness between the wall surface of the hole 33 and the outer circumferential surface 156 of the filter 151.

The seal members 51 are formed from a synthetic resin impermeable to water and air (e.g., NBR "nitrile butadiene rubber"). Each of the seal members 51 also includes a large-diameter portion 55, and a small-diameter portion 54 having an outer diameter smaller than that of the large-diameter portion 55. The filter 51 further includes an electric-wire insertion hole 52 in which the second electric wire 311 is inserted. The outer circumferential surface of the small-diameter portion 54 is crimped by the seal-member crimp portion 25 so that liquid-tightness between the outer circumferential surface of the insulating coating layer 313 of the first electric wire 311 is secured. The large-diameter portion 55 has two flange-like lip portions 57 projecting radially outward and spaced apart from one another in the front-rear direction such that the large-diameter portion 55 is narrowed in its intermediate region with respect to the front-rear direction. In a free state, the lip portions 57 have an outside diameter greater than the diameter of the circular bore 37 of the hole 33.

The housing 31 of the connector 1 of the present mode has four holes, one first hole 33 and three second holes 311. The first and second metal terminals 21, 321 are inserted into respective first and second holes 33, 333 from inlets 34, 334 (left in FIG. 1). Lances (resin lances) 35, 335 which extend rightward in FIG. 1 and integrally with the housing 31 are provided in respective first and second holes 33, 333 on a deep side (at a right side in FIG. 1) of the housing 31. Each of the lances 35, 335 has an engaging projection 36, 336 on the lower side thereof as represented by the broken line in FIG. 1. The engaging projections 36, 336 are engaged with socket-type fitting portions 22, 322 of the first and second metal terminals 21, 321 so as to hold the first and second metal terminals 21, 321 within the housing 31.

Figure 3:
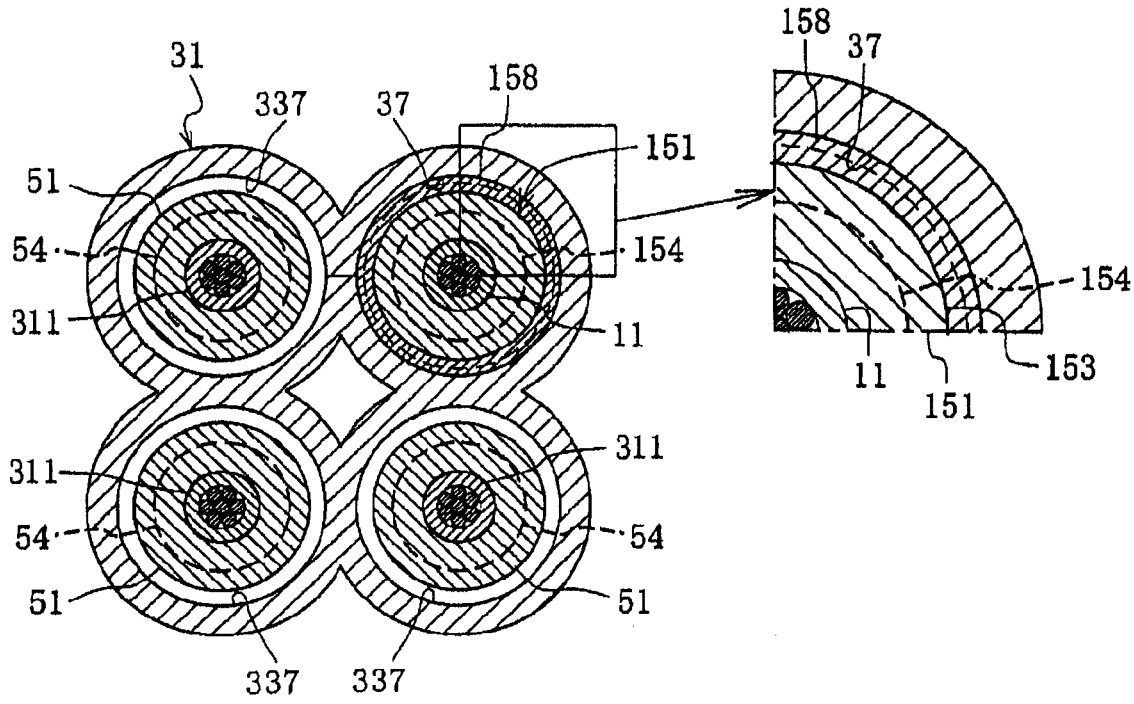
FIG. 3 is a sectional view of the waterproof connector taken along line A-A of FIG. 1 and an enlarged view of certain portions thereof.

As shown in FIG. 3, each of the first and second holes 33, 333 includes a circular bore 37, 337 having a circular cross section; and a rectangular bore 39, 339 having a rectangular cross section. Each of the rectangular bores 39, 339 has a stopper projection 40, 340 at its end.

A portion of an outer peripheral surface 32 of the housing 31 which corresponds to the rectangular bores 39, 339 of the first and second holes 33, 333 assumes a rectangular shape as viewed from the front side (right side in FIG. 1). As shown in FIG. 4, in connection with the counterpart waterproof connector 201, a hood 203 of the waterproof connector 201 is externally fitted to the outer peripheral surface 32 of the housing 31 via a waterproof ring packing 205 disposed on an inner peripheral surface of the hood 203, thereby forming a seal against the outer peripheral surface 32. As shown in FIG. 3, a portion of the connector 1 of the present mode which corresponds to the circular bores 37, 337 of the first and second holes 33, 333 assumes the following shape as viewed from the side of the inlets 34 (left side in FIG. 1): outer walls of the circular bores 37, 337 (cylinders) are integrally bundled in such a manner as to be arranged at equal angular intervals. A lock projection 45 is formed on the outer peripheral surface 32 of the housing 31 for effecting a housing lock when the waterproof connectors 1 and 201 are mated.

In each of the female first and second metal terminals 21, 321, each of the front-end socket-type fitting portions 22, 322 has a predetermined length. A male terminal 222 of each of male metal terminals 221 of the counterpart waterproof connector 201 is fitted into the socket-type fitting portion 22, 322 from a front end 24, 324 of the socket-type fitting portion 22, 322 (see FIG. 4).

As mentioned previously, each of the seal members 51 or the filter 151 is externally fitted to a portion of the insulating coating layer 13 of the first electric wire 11 which is located in the vicinity of an end of the first electric wire 11. In this condition, the exposed core wire 15 of the first electric wire 11 is crimped by the core wire crimp portions 23 of the metal terminal 21; and the small-diameter portion 54 of the seal members 51 or the small-diameter portion 154 of the filter 151 which is fitted to an end portion of the first electric wire 11 is crimped by the seal-member crimp portion 25 of the first and second metal terminals 21, 321. This crimping work enhances close contact between the wall surface of the electric-wire insertion hole 52 of the seal member 51 through which the first electric wire 11 is inserted, and the outer circumferential surface of the insulating coating layer 13 of the first electric wire 11, thereby enhancing liquid-tightness therebetween. Similarly, this crimping work enhances close contact between the wall surface of the electric-wire insertion hole 152 of the filter 151 through which the first electric wire 11 is inserted, and the outer circumferential surface of the insulating coating layer 13 of the first electric wire 11, thereby enhancing liquid-tightness therebetween.

Figure 5:
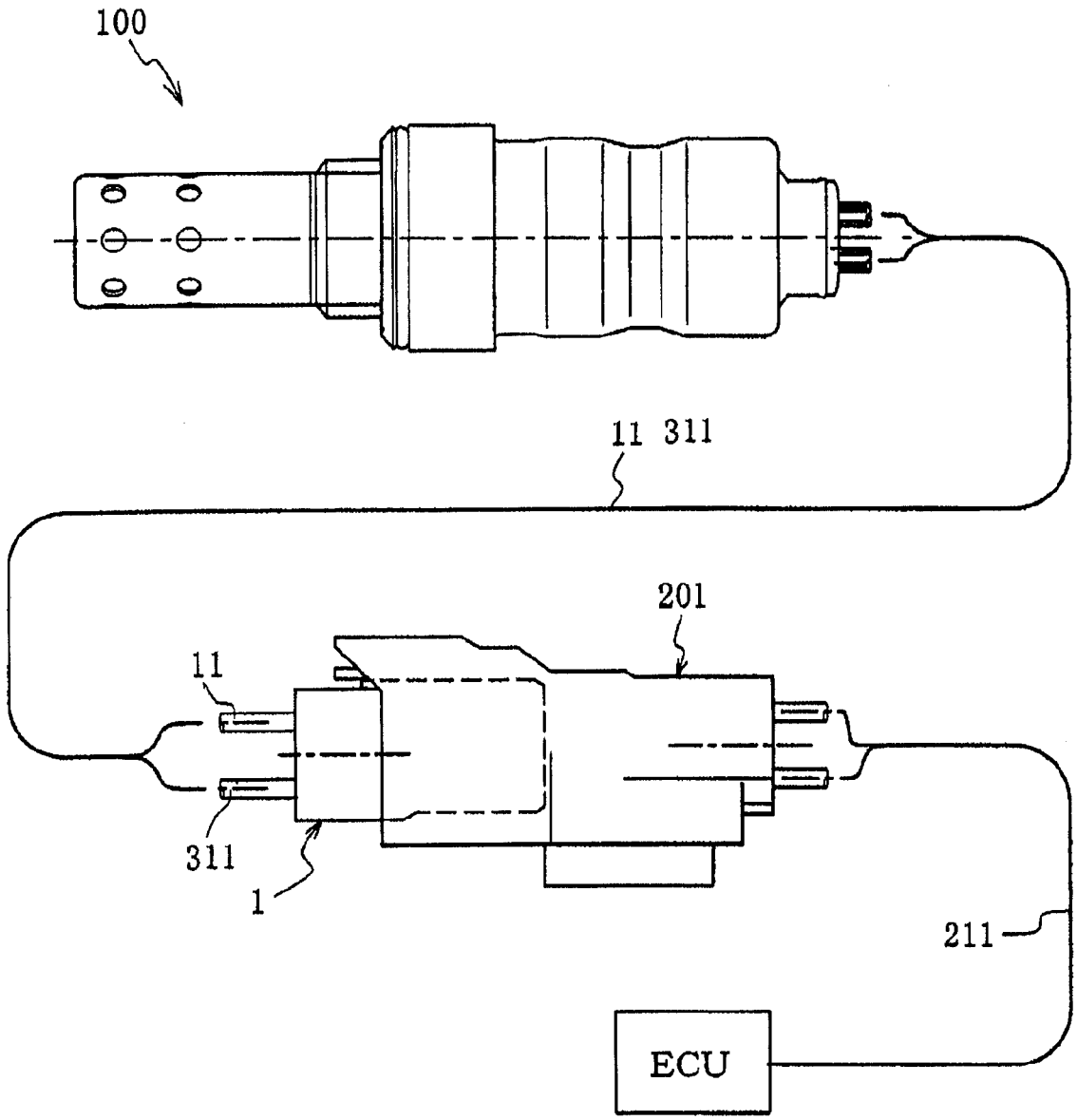
FIG. 5 is a view showing a connector arranged between a gas sensor and an ECU.

Accordingly, for example, in the case where the waterproof connector 1 of the present mode is attached to end portions (terminals) of the first and second electric wires 11, 311 extending outwardly from a gas sensor (completely waterproof sensor) 100 shown in FIG. 5 to thereby form a gas sensor unit, and the waterproof connector 1 is mated with the counterpart waterproof connector 201 connected to an ECU (engine control unit), the following effect is realized. Even in a condition in which a flaw is present in an insulating coating layer of the electric wire 211 extending between the counterpart waterproof connector 201 and the ECU, and the flawed portion of the electric wire 211 is immersed in water, and even when the pressure of the internal space of the sensor 100 drops, entry of water into the connectors 1 and 201 and the sensor 100 is prevented by virtue of the filter 151 provided in the waterproof connector 1 of the present mode.

Also, even when the pressure of the internal space of the sensor 100 increases through application of heat, air in the internal space flows through fine clearances between core wires covered with the insulating coating layers 13, 313 of the first and second electric wires 11, 311 and is vented through the filter 151 of the waterproof connector 1 of the present embodiment to the exterior of the waterproof connector 1. Thus, the internal space is maintained at atmospheric pressure (atmospheric pressure as measured at the exterior of the waterproof connector). Accordingly, even when the gas sensor 100 has a waterproof structure that an air-permeable filter allowing passage of air to the internal space of the gas sensor 100 is not provided, use of the waterproof connector 1 of the present mode in the gas sensor unit prevents both pressure variation in the internal space and entry of foreign matter such as water.

Figure 6:
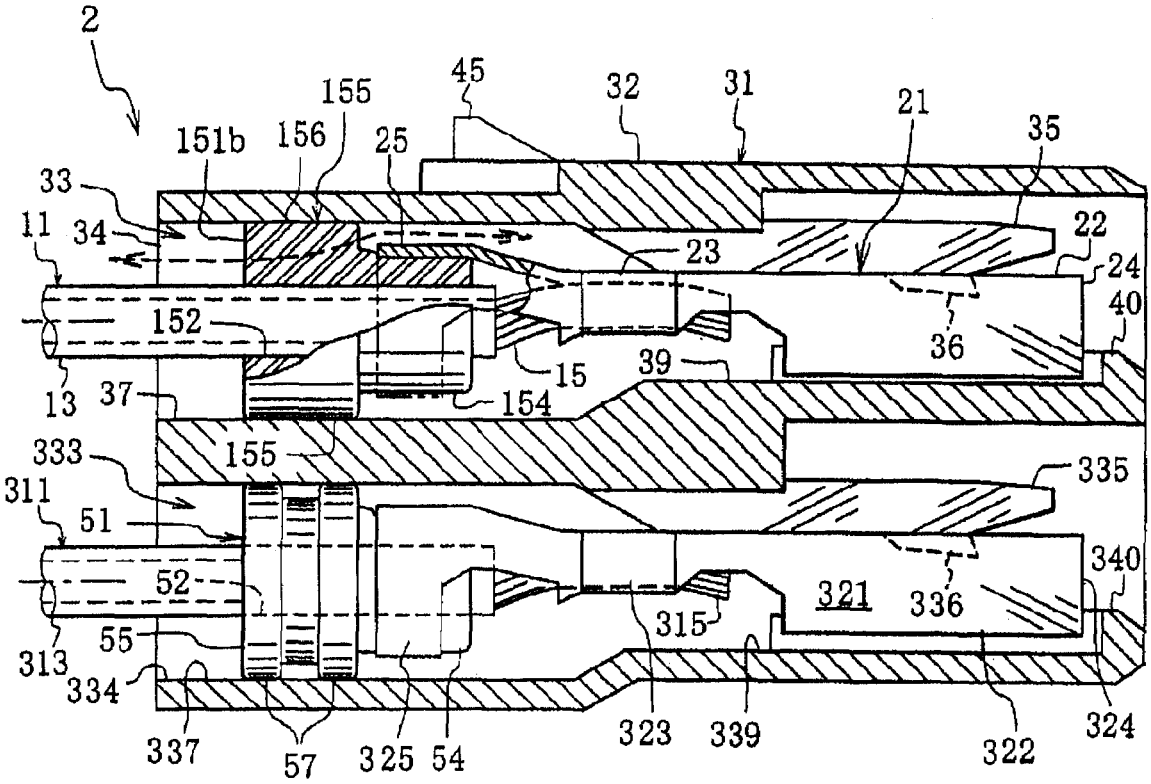
FIG. 6 is a sectional view showing the waterproof connector of an embodiment of the invention having a modified filter.

The above mode is described in the case where the ring packing 158 is disposed in the groove 153 formed on the outer circumferential surface 156 of the filter 151 impermeable to liquid and permeable to air, and is pressed against the wall surface of the hole 33 to thereby maintain liquid-tightness between the outer circumferential surface 156 and the wall surface of the hole 33 by establishing close contact therebetween. However, the filter 151 is not limited thereto. For example, FIG. 6 shows a connector 2 whose filter is a modification of the filter 151 of the above mode such that the groove 153 and the ring packing 158 are eliminated. The waterproof connector 2 of FIG. 6 differs from the waterproof connector of FIG. 1 only in that a filter 151*b* assumes a shape different from that of the filter 151. Thus, like features are denoted by like reference numerals, and only the differences will be described (the same convention also applies to another modification described below). In FIG. 6, the filter 151*b* is embodied such that the groove 153 is not formed on the outer circumferential surface 156 of the large-diameter portion 155. The cylindrical, outer circumferential surface 156 and the wall surface of the hole 33 are in close contact with each other, thereby maintaining liquid-tightness therebetween. Such close contact can be established by imparting an outside diameter greater than the diameter of the circular bore 37 of the hole 33 to the large-diameter portion 155 and press-fitting the large-diameter portion 156 into the circular bore 37. When such press fit is to be employed, slight tapering of the large-diameter portion 155 is preferred.

Figure 7:
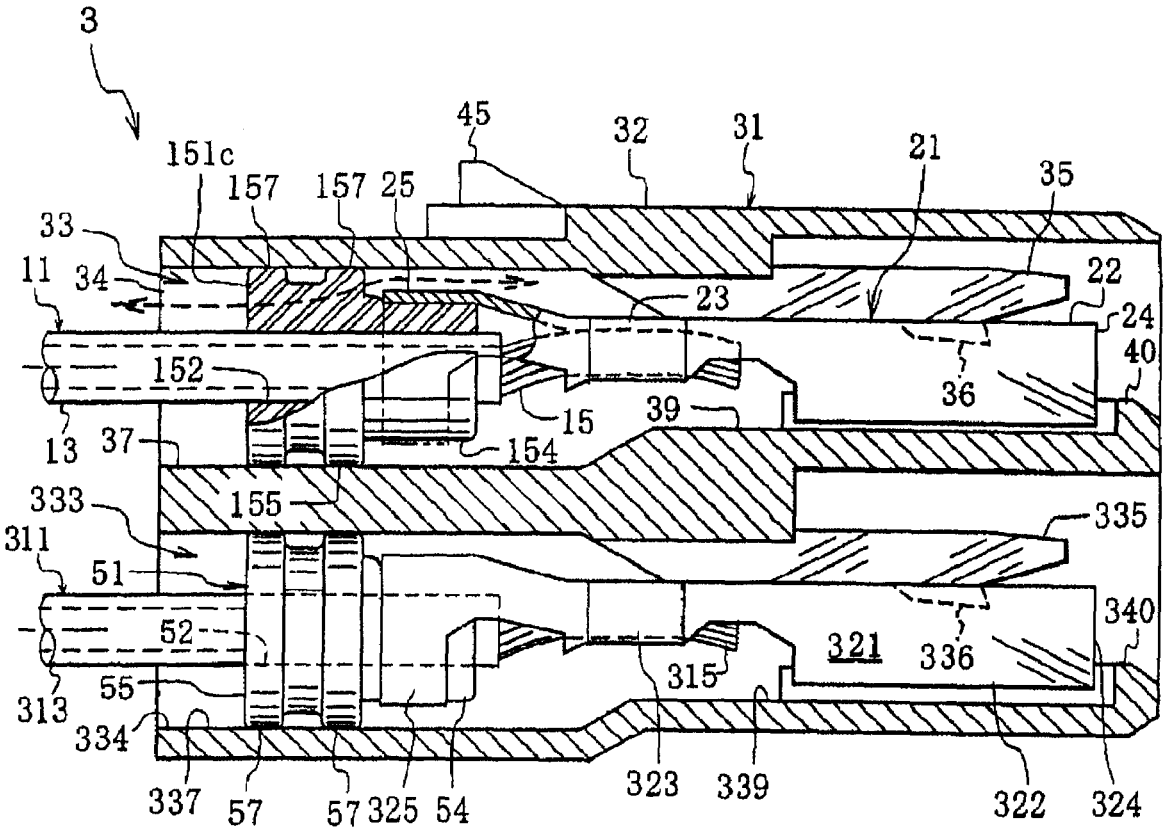
FIG. 7 is a sectional view showing the waterproof connector of an embodiment of the invention having yet another modified filter.

The above mode is described in the case where the outer circumferential surface of the filter 151*b* impermeable to liquid and permeable to air is directly pressed against the wall surface of the hole 33, whereby liquid-tightness is maintained between the surfaces by establishing close contact therebetween. However, a portion of the outer circumferential surface of a filter may be directly pressed against the wall surface of the hole 33, whereby liquid-tightness is maintained indirectly between the surfaces. FIG. 7 shows a connector 3 employing such a filter 151*c*. In the waterproof connector 3, the large-diameter portion 155 has two flange-like lip portions 157 projecting radially outward and spaced apart from one another in the front-rear direction such that the large-diameter portion 155 is narrowed in its intermediate region with respect to the front-rear direction. In a free state, the lip portions 157 have an outside diameter greater than the diameter of the circular bore 37 of the hole 33. As in the case of the above mode, the filter 151*c* may be press-fitted into the hole 33.

It should further apparent to those skilled in the art that various changes in form and detail of the invention as shown and described above may be made. It is intended that such changes be included within the spirit and scope of the claims appended hereto.

This application is based on Japanese Patent Application No. 2006-190923 filed Jul. 11, 2006, incorporated herein by reference in its entirety.

What is claimed is:

1. A waterproof connector comprising:

a housing having first and second holes;

a first electric wire inserted into the first hole, the first electric wire including a core wire and a insulating coating layer covering the core wire;

a first metal terminal connected with the core wire of the first electric wire in the first hole;

a filter impermeable to liquid and permeable to air arranged between an outer circumferential surface of the insulating coating layer of the first electric wire and a wall surface of the first hole;

a second electric wire inserted into the second hole, the second electric wire including a core wire and a insulating coating layer covering the core wire;

a second metal terminal connected with the core wire of the second electric wire in the second hole, and a seal member impermeable to liquid and air arranged between an outer circumferential surface of the insulating coating layer of the second electric wire and a wall surface of the second hole.

2. The waterproof connector according to claim 1, wherein the first metal terminal comprises:

a first core wire crimp portion crimping the core wire of the first electric wire, and a filter crimp portion crimping the filter.

3. The waterproof connector according to claim 2, wherein the filter comprises a large-diameter portion, and a small-diameter portion having an outer diameter smaller than that of the large-diameter portion, the small-diameter portion being crimped by the filter crimp portion of the first metal terminal.

4. The waterproof connector according to claim 1, further comprising a ring packing arranged between an outer circumferential surface of the filter and the wall surface of the first hole.

5. The waterproof connector according to claim 1, wherein an outer circumferential surface of the filter is pressed directly against the wall surface of the hole.

6. The waterproof connector according to claim 1, wherein the second metal terminal comprises:

a second core wire crimp portion crimping the core wire of the second electric wire, and a seal member crimp portion crimping the seal member.

7. The waterproof connector according to claim 6, wherein the seal member comprises a large-diameter portion, and a small-diameter portion having an outer diameter smaller than that of the large-diameter portion, the small-diameter portion being crimped by the seal member crimp portion of the second metal terminal.

8. The waterproof connector according to claim 1, wherein an outer circumferential surface of the seal member is pressed directly against the wall surface of the second hole.

9. The waterproof connector according to claim 1, comprising said second hole in a greater number than said first hole.

* * * * *